US011145963B2

(12) United States Patent
Liu et al.

(10) Patent No.: US 11,145,963 B2
(45) Date of Patent: Oct. 12, 2021

(54) ANTENNA, ANTENNA CONTROL METHOD AND DEVICE, AND TERMINAL

(71) Applicant: ZTE CORPORATION, Guangdong (CN)

(72) Inventors: Fengpeng Liu, Guangdong (CN); Dongmei Liu, Guangdong (CN)

(73) Assignee: ZTE CORPORATION, Shenzhen (CN)

( * ) Notice: Subject to any disclaimer, the term of this patent is extended or adjusted under 35 U.S.C. 154(b) by 95 days.

(21) Appl. No.: 16/605,019

(22) PCT Filed: Feb. 2, 2018

(86) PCT No.: PCT/CN2018/075079
§ 371 (c)(1),
(2) Date: Oct. 14, 2019

(87) PCT Pub. No.: WO2018/205696
PCT Pub. Date: Nov. 15, 2018

(65) Prior Publication Data

US 2021/0104815 A1 Apr. 8, 2021

(30) Foreign Application Priority Data

May 12, 2017 (CN) ..... 201710334567.6

(51) Int. Cl.
*H01Q 1/36* (2006.01)
*H01Q 1/08* (2006.01)
*H01Q 1/38* (2006.01)

(52) U.S. Cl.
CPC ..... *H01Q 1/364* (2013.01); *H01Q 1/08* (2013.01); *H01Q 1/38* (2013.01)

(58) Field of Classification Search
CPC ..... H01Q 1/364; H01Q 1/08; H01Q 1/081; H01Q 1/38; H01Q 9/20; H01Q 1/36
See application file for complete search history.

(56) References Cited

U.S. PATENT DOCUMENTS 8,950,266 B2 * 2/2015 Dickey ..... G01L 1/205 73/763
2011/0109519 A1 5/2011 Quan et al.

FOREIGN PATENT DOCUMENTS

CN 106654503 A 5/2017

OTHER PUBLICATIONS

International Search Report of PCT Patent Application No. PCT/CN2018/075079 dated Apr. 12, 2018.

* cited by examiner

*Primary Examiner* — Hoang V Nguyen

(57) ABSTRACT

Disclosed are an antenna, an antenna control method and device, and a terminal. The antenna is applied to a terminal and includes: an antenna radiator container, an amorphous antenna radiator, and an antenna radiator control unit. The antenna radiator container is provided with a sealed accommodating cavity; the amorphous antenna radiator is provided in the accommodating cavity of the antenna radiator container; and the antenna radiator control unit is connected with the antenna radiator container and controls a configuration of the amorphous antenna radiator in the accommodating cavity, the configuration including a relative position of the amorphous antenna radiator in the accommodating cavity, or including a shape of the amorphous antenna radiator, or including a relative position of the amorphous antenna radiator in the accommodating cavity and a shape of the amorphous antenna radiator.

10 Claims, 8 Drawing Sheets

ANTENNA, ANTENNA CONTROL METHOD AND DEVICE, AND TERMINAL

FIELD OF THE INVENTION

This application relates to, but is not limited to, the technical field of communications, and in particular, relates to an antenna, an antenna control method and device, and a terminal.

BACKGROUND OF THE INVENTION

In communication terminal devices, wireless communication experience is one of the most important performance indicators. Antennas can have a direct effect on performance of wireless communication, and external factors can have a relatively large effect on communication quality and communication effects of antennas.

SUMMARY OF THE INVENTION

The following is a summary of subject matters detailed herein. This summary is not intended to limit the protection scope of the claims.

An antenna of a communication terminal is typically realized through an antenna radiator and a corresponding circuit structure fixed inside the terminal. The antenna radiator can exhibit different communication quality under different operation states of the terminal due to effects of other factors besides the antenna itself. It is usually difficult for the antenna of a terminal to exhibit a good communication effect under any operation states of the terminal.

The present disclosure provides an antenna, an antenna control method and device, and a terminal.

The antenna provided by the embodiments of the present disclosure is applied to a terminal. The antenna includes: an antenna radiator container, an amorphous antenna radiator, and an antenna radiator control unit.

The antenna radiator container is provided with a sealed accommodating cavity.

The amorphous antenna radiator is provided in the accommodating cavity of the antenna radiator container.

The antenna radiator control unit is connected with the antenna radiator container and is configured to control a configuration of the amorphous antenna radiator in the accommodating cavity. The configuration includes a relative position of the amorphous antenna radiator in the accommodating cavity, or includes a shape of the amorphous antenna radiator, or includes a relative position of the amorphous antenna radiator in the accommodating cavity and a shape of the amorphous antenna radiator.

In an exemplary embodiment, the amorphous antenna radiator is made of a material that is a liquid metal.

In an exemplary embodiment, the accommodating cavity is provided therein with a plurality of separators dividing the accommodating cavity into tubular sub-cavities, the tubular sub-cavities being parallel to one another in extension directions thereof and being in communication with one another.

In an exemplary embodiment, the antenna radiator control unit includes a gas pump and a gas delivery pipe.

The gas delivery pipe is connected at one end thereof with the gas pump, and is connected at the other end thereof with the accommodating cavity.

The gas pump is configured to control the shape of the amorphous antenna radiator and the relative position of the amorphous antenna radiator in the accommodating cavity by drawing a gas in the accommodating cavity.

In an exemplary embodiment, the antenna radiator control unit includes a heater and a heating pipe.

The heating pipe is connected at one end thereof with the heater, and is connected at the other end thereof the accommodating cavity.

The heater is configured to control the shape of the amorphous antenna radiator and the relative position of the amorphous antenna radiator in the accommodating cavity by controlling a temperature of a gas in the accommodating cavity.

In an exemplary embodiment, the heating pipe is electrically connected with the amorphous antenna radiator, and is configured to change the shape of the amorphous antenna radiator by controlling a temperature of the amorphous antenna radiator.

In an exemplary embodiment, the antenna radiator container is made of a plastic material, a different between a dielectric constant of the plastic material and a dielectric constant of the amorphous antenna radiator being greater than a preset value.

In an exemplary embodiment, when provided is a plurality of antenna radiator containers, the antenna further includes an equal-impedance electric conductor that electrically connects amorphous antenna radiators in the antenna radiator containers together.

In an exemplary embodiment, the equal-impedance electric conductor is a wire.

Or, the equal-impedance electric conductor includes a conductor container and an amorphous conductor filled in the conductor container, the amorphous conductor electrically connecting the amorphous antenna radiators in the antenna radiator containers together.

The embodiments of the present disclosure also provide an antenna control method applied to the antenna according to any of embodiments of the present disclosure. The method includes:

detecting a current operation state of the terminal;

determining a target configuration of the amorphous antenna radiator, the target configuration including a target position of the amorphous antenna radiator in the accommodating cavity, or including a target shape of the amorphous antenna radiator, or including a target position of the amorphous antenna radiator in the accommodating cavity and a target shape of the amorphous antenna radiator; and controlling the amorphous antenna radiator through the antenna radiator control unit, such that the position, the shape, or the position and the shape of the amorphous antenna radiator are consistent with the target position, the target shape, or the target position and the target shape, respectively.

In an exemplary embodiment, the step of determining the target configuration of the amorphous antenna radiator includes:

looking up a target configuration of the amorphous antenna radiator under the current operation state of the terminal based on a corresponding relationship between a preset terminal state and the position and the shape of the amorphous antenna radiator, or determining a target configuration of the amorphous antenna radiator based on a received debug control instruction.

In an exemplary embodiment, the step of detecting a current operation state of the terminal includes:

detecting a gesture of a user of the terminal of using the terminal, or, detecting quality of a communication network currently used by the terminal, or detecting a frequency band currently used by the terminal.

Embodiments of the present disclosure provide computer-readable storage medium storing thereon with computer-executable instructions. The computer-executable instructions, when executed by a processor, implement the antenna control method described above.

Embodiments of the present disclosure also provide an antenna control device for controlling the antenna according to any of the embodiments of the present disclosure. The antenna control device includes:

an operation state detecting module, configured to detect a current operation state of the terminal;

a target configuration determining module, configured to determine a target configuration of the amorphous antenna radiator, the target configuration including a target position of the amorphous antenna radiator in the accommodating cavity, or including a target shape of the amorphous antenna radiator, or including a target position of the amorphous antenna radiator in the accommodating cavity and a target shape of the amorphous antenna radiator; and an antenna control module, configured to control the amorphous antenna radiator through the antenna radiator control unit, such that the position and the shape of the amorphous antenna radiator are consistent with the target position and the target shape, respectively.

In an exemplary embodiment, the target configuration determining module includes:

a look-up unit, configured to look up a target configuration of the amorphous antenna radiator under the current operation state of the terminal based on a corresponding relationship between a preset terminal state and the position and the shape of the amorphous antenna radiator, or a debug control unit, configured to determine a target configuration of the amorphous antenna radiator based on a received debug control instruction.

In an exemplary embodiment, the operation state detecting module includes at least one of the following three units:

a using gesture detecting unit, configured to detect a gesture of a user of the terminal of using the terminal;

a quality detecting unit, configured to detect quality of a communication network currently used by the terminal; and a using frequency band detecting unit, configured to detect a frequency band currently used by the terminal.

Embodiments of the present disclosure also provide a terminal including the antenna according to any of embodiments of the present disclosure. The terminal further includes the antenna control device according to any of embodiments of the present disclosure.

Embodiments of the present disclosure also provide a terminal including a processor, a memory, and a computer program stored on the memory and executable on the processor. The processor, when executing the computer program, implements steps of the antenna control method according to any of embodiments of the present disclosure.

The antenna, the antenna control method and device, and the terminal provided by the embodiments of the present disclosure can change the position and shape of the antenna radiator according to the operation state of the terminal, so that the antenna radiator can have a configuration that meets a target configuration requirement under the operation state of the terminal, and thus realize optimal antenna communication effects under the current operation state of the terminal. The communication quality of the antenna can thus be improved, and the stability of the communication quality of the antenna in various scenarios and environments can also be improved.

Other aspects will be apparent upon reading and understanding the figures and the detailed description.

DETAILED DESCRIPTION OF THE EMBODIMENTS

Technical solutions in embodiments of the present disclosure will be explicitly and fully described below with reference to the accompanying drawings used in the embodiments.

Figure 1:
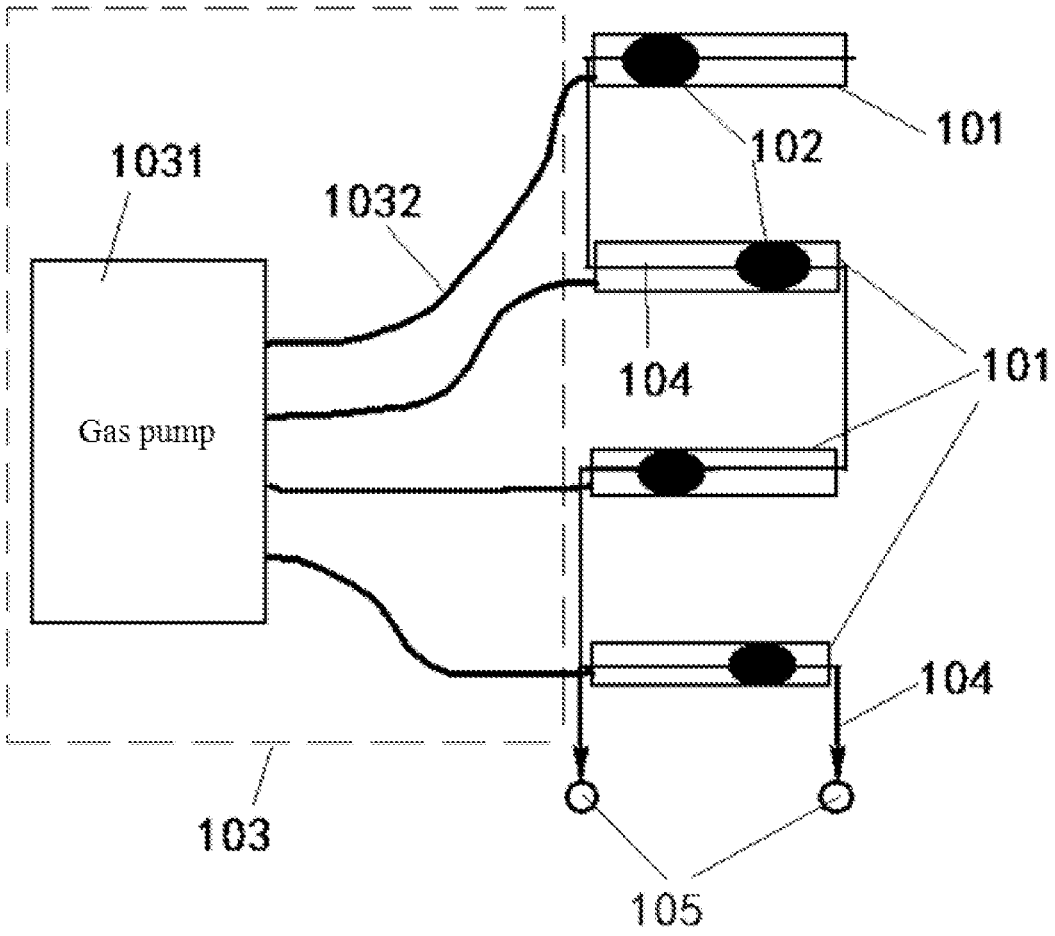
FIG. 1 is a schematic diagram showing a structure of an antenna according to an embodiment of the present disclosure.

An embodiment of the present disclosure provides an antenna applied to a terminal. As shown in FIG. 1, the antenna includes: an antenna radiator container 101, an amorphous antenna radiator 102, and an antenna radiator control unit 103.

The antenna radiator container 101 is provided with a sealed accommodating cavity having a volume larger than a total volume of the amorphous antenna radiator 102.

The amorphous antenna radiator 102 is provided in the accommodating cavity of the antenna radiator container 101.

The antenna radiator control unit 103 is connected with the antenna radiator container 101, and controls a relative position of the amorphous antenna radiator 102 in the accommodating cavity, or controls a shape of the amorphous antenna radiator 102, or controls a relative position of the amorphous antenna radiator 102 in the accommodating cavity and a shape of the amorphous antenna radiator 102. The shape includes, but is not limited to, one or more of a length, a width, a thickness, an area, and a surface area and so on of the amorphous antenna radiator 102.

As can be seen, in the antenna provided by the present embodiment, the antenna radiator adopted is an amorphous antenna radiator which is packaged in an antenna radiator container, an accommodating cavity of the container having a volume larger than a total volume of the amorphous antenna radiator, by way of which, parameters effecting communication effects of the antenna, such as the shape, the position and so on of the amorphous antenna radiator, are controlled through the antenna radiator control unit according to different operation states of the terminal. By controlling the relative position of the amorphous antenna radiator 102 in the accommodating cavity, or the shape of the amorphous antenna radiator 102, or the relative position of the amorphous antenna radiator 102 in the accommodating cavity and the shape of the amorphous antenna radiator 102, the antenna configuration of the terminal is changed, so that the antenna can provide an optimal communication effect for the terminal under its current operation state.

Meanwhile, the amorphous antenna radiator 102 per se is an amorphous substance. The amorphous antenna radiator 102, for example, can be a liquid substance, a powdery substance, a colloidal substance and the like that facilitates change of the antenna configuration of the terminal. Besides, the packaging of the amorphous antenna radiator within the antenna radiator container can avoid leakage of the substance of the amorphous antenna radiator.

In an exemplary embodiment of the present disclosure, the antenna radiator container may have a flat shape so as to be easily embedded internally on a housing of the terminal. In addition, a difference between a dielectric constant of a manufacturing material of the antenna radiator container and a dielectric constant of the amorphous antenna radiator is larger than a preset value.

In an exemplary embodiment of the present disclosure, when two feed points are provided, an equal-impedance wire is connected at an end thereof with one of the feed points and is connected at another end thereof with the other one of the feed points, and extends from one of the feed points to the antenna radiator container and then to the other one of the feed points.

In an exemplary embodiment of the present disclosure, in order to ensure effects of use, provided are two or more antenna radiator containers. Each of the antenna radiator containers is provided therein with an amorphous antenna radiator. The equal-impedance wire passes through all the antenna radiator containers.

In some embodiments of the present disclosure, the amorphous antenna radiator may be made of a material that is a liquid metal. The liquid metal exhibits a certain degree of viscosity, and can be kept as a whole in the process of changing the configuration of the antenna radiator. Meanwhile, the liquid metal exhibits liquidity, and can change the shape, the position, or the shape and the position of the amorphous antenna radiator in the antenna radiator container under certain conditions.

If the amorphous antenna radiator is made of a liquid metal, the antenna radiator container may be made of a material having a dielectric constant similar to that of the plastic.

In another embodiment of the present disclosure, referring still to FIG. 1 for the structure of the antenna, the antenna includes: an antenna radiator container 101, an amorphous antenna radiator 102, an antenna radiator control unit 103, an equal-impedance wire 104, and at least two feed points 105.

The antenna radiator container 101 is provided with a sealed accommodating cavity having a volume larger than a total volume of the amorphous antenna radiator 102.

The amorphous antenna radiator 102 is provided in the accommodating cavity of the antenna radiator container 101.

The antenna radiator control unit 103 is connected with the antenna radiator container 101, and controls a relative position of the amorphous antenna radiator 102 in the accommodating cavity, or a shape of the amorphous antenna radiator 102, or a relative position of the amorphous antenna radiator 102 in the accommodating cavity and a shape of the amorphous antenna radiator 102. The shape includes, but is not limited to, one or more of a length, a width, a thickness, an area and a surface area and so on of the amorphous antenna radiator 102.

The equal-impedance wire 104 passes through the accommodating cavity of the antenna radiator container 101 and is connected with the feed points.

The feed points may be used as connection points between the antenna and other components. In other embodiments, provided is one or more feed points. In the case where a feed point is provided, it is required that the feed point be electrically connected with the amorphous antenna radiator. In the case where a plurality of antenna radiator containers is provided, the equal-impedance wire electrically connects the amorphous antenna radiators in the plurality of antenna radiator containers together. For example, the equal-impedance wire connects antenna radiator containers arranged in a loop in sequence, such that two or more antenna radiator containers arranged in a loop are electrically connected to one another. As another example, the equal-impedance wire sequentially passes through two or more antenna radiator containers arranged longitudinally or laterally, such that antenna radiators in the two or more antenna radiator containers are electrically connected to one another.

Figure 2:
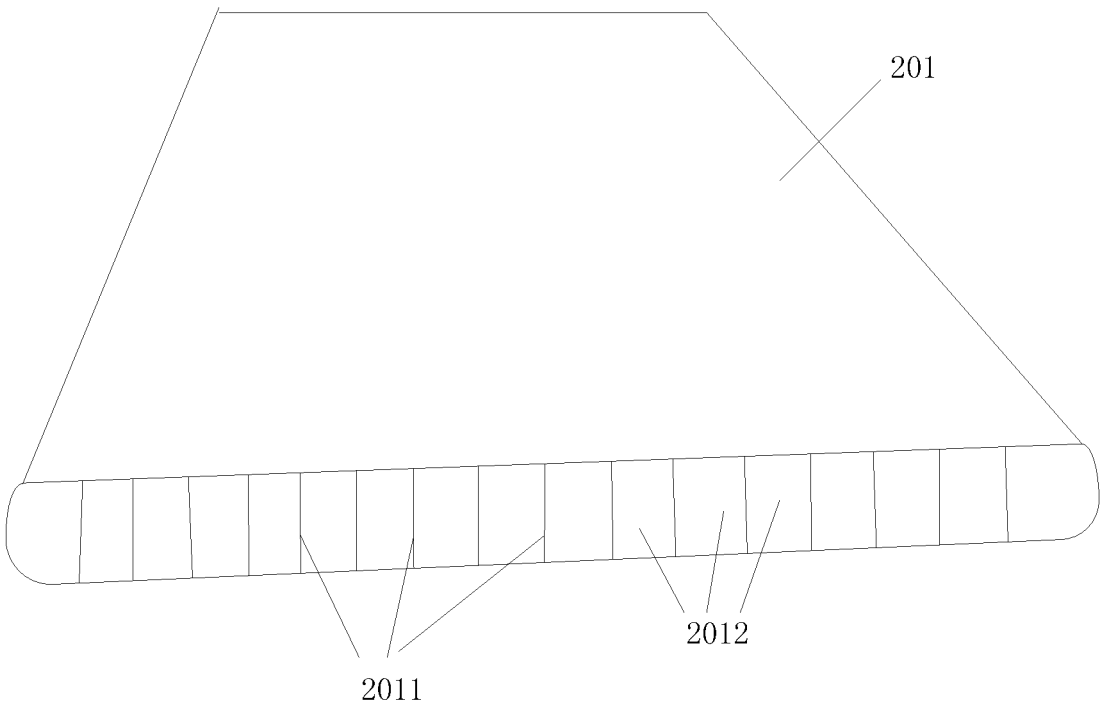
FIG. 2 is a schematic diagram showing an antenna radiator container according to an embodiment of the present disclosure.

In some embodiments of the present disclosure, the antenna radiator container is as shown in FIG. 2. The accommodating cavity is provided therein with a plurality of separators 2011. The plurality of separators 2011 divides the accommodating cavity into tubular sub-cavities 2012 that are parallel to one another in extension directions thereof, enabling the accommodating cavity 201 to become a porous container. The antenna radiator container as shown in FIG. 2 is sealed at two ends thereof, such that the amorphous antenna radiator does not flow out of the accommodating cavity 201. Such a structure can increase a contact area between the amorphous antenna radiator and the accommodating cavity, and assists in the attaching of the amorphous antenna radiator to a wall of the accommodating cavity, so that after changing the shape of the amorphous antenna radiator, the amorphous antenna radiator maintains the changed shape without active deformation. When the tubular sub-cavities 2012 are not in communication with one another, by controlling the amorphous antenna radiator in each tubular sub-cavity 2012 to be in a different position of the tubular sub-cavity 2012, an overall shape of the amorphous antenna radiator can be changed, in which way, the amorphous antenna radiator can be enabled to be in an optimal shape under certain specific operation states of the terminal.

Figure 3:
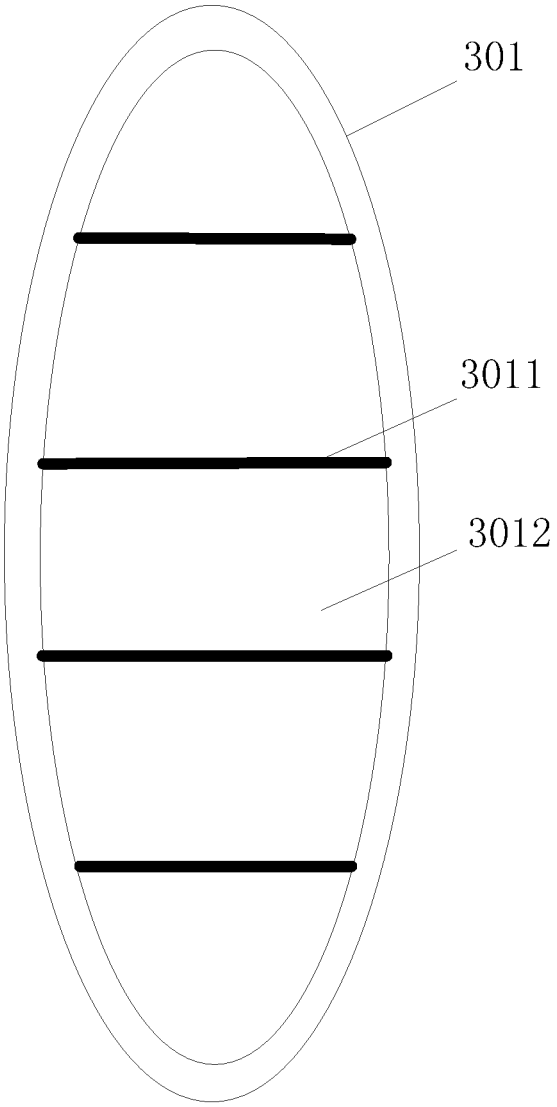
FIG. 3 is a schematic diagram showing an antenna radiator container according to another embodiment of the present disclosure.

In some embodiments of the present disclosure, the antenna radiator container is as shown in FIG. 3. The antenna radiator container 301 is provided therein with a plurality of separators 3011. The plurality of separators 3011 divides the accommodating cavity into tubular sub-cavities 3012 that are parallel to one another in extension directions thereof, enabling the accommodating cavity 301 to become a porous container. The separators 3011 each are provided therein with a through hole. The through holes enable the tubular sub-cavities 3012 to be in communication with one another, thus providing a good contact between a wall of the accommodating cavity 301 and the amorphous antenna radiator. In addition, the structure that the tubular sub-cavities 3012 are in communication with one another also ensures a uniform distribution of the amorphous antenna radiator in the accommodating cavity of the antenna radiator container 301. The antenna radiator container as shown in FIG. 3 is sealed at two ends thereof such that the amorphous antenna radiator does not flow out of the accommodating cavity.

In some embodiments of the present disclosure, referring still to FIG. 1, the antenna radiator container 101 is arranged in the form of a monopole IFA (inverted-F antenna). The antenna radiator control unit 103 includes a gas pump 1031 and a gas delivery pipe 1032.

The gas delivery pipe 1032 is connected at one end thereof with the gas pump 1031, and is connected at the other end thereof with the accommodating cavity. A connecting point between the gas delivery pipe 1032 and the accommodating cavity is sealed.

The gas pump 1031 controls the shape of the amorphous antenna radiator 102 and the relative position of the amorphous antenna radiator 102 within the accommodating cavity by drawing a gas within the accommodating cavity. Referring to FIG. 1, when the gas pump 1031 draws the gas within the accommodating cavity, the amorphous antenna radiator moves to the left of FIG. 1; and when the gas pump 1031 injects a gas into the accommodating cavity, the amorphous antenna radiator 102 moves to the right of FIG. 1. In this way, the position of the amorphous antenna radiator 102 in the accommodating cavity can be controlled under different operation states of the terminal, so that the amorphous antenna radiator 102 can be in a position that can achieve an optimal communication effect under the current operation state of the terminal. When the gas pump 1031 draws or injects the gas through the gas delivery pipe 1032, controlling of a flow direction of the gas can exert an effect on the shape of the amorphous antenna radiator 102, and the shape of the amorphous antenna radiator 102 can thus be controlled.

In an exemplary embodiment, when the gas is drawn or injected, the gas flow can be controlled from different directions by increasing connection interfaces between the gas delivery pipe 1032 and the accommodating cavity, so as to control the shape of the amorphous antenna radiator 102 more accurately.

Figure 4:
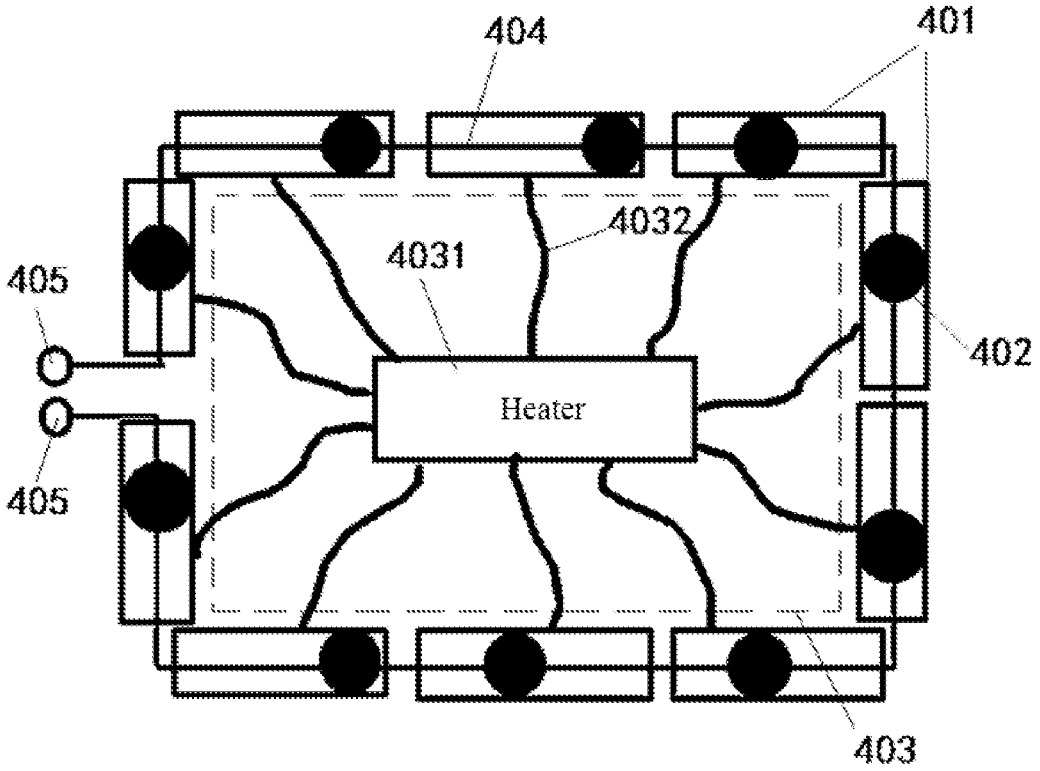
FIG. 4 is a schematic diagram showing a structure of an antenna according to another embodiment of the present disclosure.

In some embodiments of the present disclosure, referring to FIG. 4, the antenna includes a plurality of antenna radiator containers 401 arranged in the form of a loop antennal. The antenna radiator control unit 403 includes a heater 4031 and a heating pipe 4032.

The heating pipe 4032 is connected at one end thereof with the heater 4031, and is connected at the other end thereof with the accommodating cavity of the antenna radiator container 401.

The heater 4031 controls the shape of the amorphous antenna radiator 402 and the relative position of the amorphous antenna radiator 402 within the accommodating cavity of the antenna radiator container 401 by controlling the temperature of a gas within the accommodating cavity. To avoid effects of the antenna radiator container 401 on the equal-impedance wire 404, the antenna radiator container 401 is made of a non-electromagnetic sensitive material. The heater 4031 heats the gas within the accommodating cavity or cools the gas within the accommodating cavity, so that the gas within the accommodating cavity expands or contracts, thereby changing the position of the amorphous antenna radiator 402 within the accommodating cavity. The equal-impedance wire 404 is connected at each of two ends thereof with a feed point 405. The equal-impedance wire 404 between the two feed points 405 passes sequentially through all the antenna radiator containers 401.

In some embodiments of the present disclosure, referring still to FIG. 4, the heating pipe 4032 is electrically connected with the amorphous antenna radiator 402, such that the temperature of the amorphous antenna radiator 402 increases or decreases, thereby changing the shape of the amorphous antenna radiator 402 by controlling the temperature of the amorphous antenna radiator 402.

In one embodiment, the heater 4031 is capable of cooling the gas within the accommodating cavity by means of the heating pipe 4032, causing the gas within the accommodating cavity to contract.

In one embodiment, each antenna radiator container is connected at each of two ends thereof with one heating pipe, so that the expansion of the gas at two ends of the amorphous antenna radiator can be controlled.

As can be seen from the above, the antenna provided by the present embodiment has an amorphous antenna radiator which is provided in a container, and an antenna radiator control unit is used to control a configuration of the amorphous antenna radiator in an accommodating cavity, so that under different operation states of the terminal, the antenna radiator can be in a configuration that can achieve an optimal communication effect under a current operation of the terminal. The performance and quality of the antenna used under different operation states of the terminal can thus be improved.

In some embodiments of the present disclosure, the antenna radiator container is made of a plastic material, such as plastic cement, plastic, rubber, resin, and the like. A difference between a dielectric constant of the plastic material and a dielectric constant of the amorphous antenna radiator is greater than a preset value.

In some embodiments of the present disclosure, when provided is a plurality of antenna radiator containers, the antenna further includes an equal-impedance electric conductor. The equal-impedance electric conductor electrically connects amorphous antenna radiators in the antenna radiator containers together. Provided are two or more antenna radiator containers. This means that the antenna radiator containers are separated from one another, and the amorphous antenna radiators in different antenna radiator containers are separated from one another.

In some embodiments of the present disclosure, the equal-impedance electric conductor is a wire, or a component equivalent to wire, such as a conductive sheet or other forms of conductive substances or the like.

Alternatively, the equal-impedance electric conductor includes a conductor container and an amorphous conductor filled in the conductor container. The amorphous conductor electrically connects the amorphous antenna radiators in the antenna radiator containers together.

Figure 5:
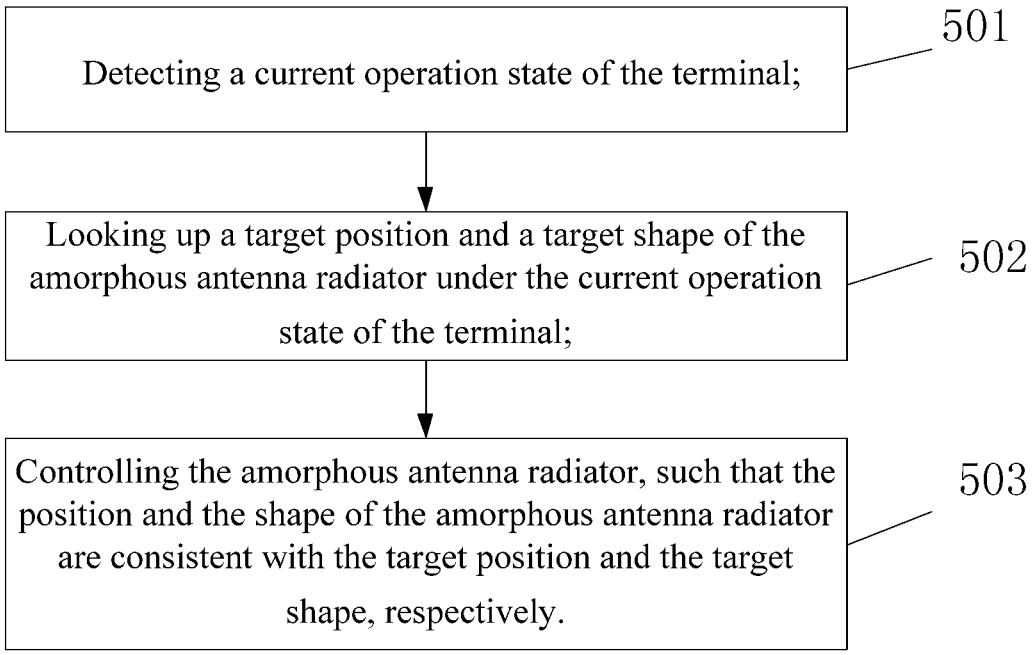
FIG. 5 is a schematic flowchart showing an antenna control method according to an embodiment of the present disclosure.

Further, an embodiment of the present disclosure provides an antenna control method including steps 501 to 503 as shown in FIG. 5.

In Step 501, a current operation state of the terminal is detected.

The operation state includes, but is not limited to, one or more of a frequency band adopted by the terminal for communication, a gesture of a user of using the terminal, communication quality of the frequency band currently used by the terminal, etc.

In Step 502, a target configuration of the amorphous antenna radiator is determined. The target configuration includes a target position, or a target shape, or a target position and a target shape.

In Step 503, the amorphous antenna radiator is controlled by the antenna radiator control unit, so that the position, the shape, or the position and the shape of the amorphous antenna radiator are consistent with the target position, the target shape, or the target position and the target shape, respectively.

In an embodiment of the present disclosure, the antenna control method is applied to the antenna provided by any of the embodiments of the present disclosure and a terminal having the antenna.

Before Step 501, an antenna configuration, such as the relative position of the amorphous antenna radiator in the accommodating cavity, the overall shape of the amorphous antenna radiator and the like, capable of achieving an optimal communication effect under different operation states of the terminal can be determined through multiple tests, and then a corresponding relationship between said position and shape parameters and a corresponding operation state of the terminal is established, recorded and stored. When it is detected that the current operation state of the terminal is a first state in the record, an optimal antenna configuration corresponding to the first state is looked up, and the antenna radiator control unit is used to control the amorphous antenna radiator, so that the configuration of the amorphous antenna radiator is changed to the optimal antenna configuration corresponding to the first state.

In some embodiments of the present disclosure, the step of determining the target configuration of the amorphous antenna radiator includes:

looking up a target configuration of the amorphous antenna radiator under the current operation state of the terminal based on a corresponding relationship between a preset terminal state and a position and a shape of the amorphous antenna radiator; or determining a target shape of the amorphous antenna radiator based on a received debug control instruction.

In practical use, the operation state of the terminal includes: a gesture of a user of using the terminal, quality of a communication network currently used by the terminal, a frequency band currently used by the terminal, etc. Therefore, in some embodiments of the present disclosure, the step of detecting the current operation state of the terminal includes the following steps of:

detecting a gesture of a user of the terminal of using the terminal, the gesture including: holding the terminal by hand for use, placing the terminal on a support for use, using the terminal through an earphone, or covering a portion of the terminal, etc., or detecting quality of a communication network currently used by the terminal, for example, detecting strength of a communication signal currently used by the terminal; or detecting a frequency band currently used by the terminal, the frequency band used including all frequency bands divided according to a current communication protocol.

In one embodiment, referring to FIG. 4 for structure of the antenna, a frequency band currently used by the terminal is detected. For example, the terminal is currently using the LTE (Long Term Evolution) frequency band of B41. After a look-up, a first target configuration of the antenna, which is including a first target position, or including a first target shape, or including a first target position and a first target shape, and a relative position of the antenna radiator 402 in the accommodating cavity of the antenna radiator container 401 corresponding to the first target configuration are determined, so that the antenna in the first target configuration can achieve an optimal performance in the LTE frequency band of B41. Then, the heater 4031 is controlled to move the amorphous antenna radiator 402 to a corresponding position, or change the shape of the amorphous antenna radiator 402, or change the position and the shape of the amorphous antenna radiator 402, so that the antenna is in the first target configuration.

In another embodiment, referring still to FIG. 4 for structure of the antenna, it is detected that a gesture of a user of the terminal of using the terminal is holding the terminal by hand, and it is further detected an operation state of the terminal is that the user browses a webpage in a mode of holding the terminal by hand. After a look-up, it is determined that when the antenna is in a second target configuration, an optimal communication effect can be achieved under the operation state that the user browses a webpage by holding the terminal by hand; and a relative position of the antenna radiator 402 in the accommodating cavity of the antenna radiator container 401 and a shape of the antenna radiator 402 corresponding to the second target configuration are determined. Then, the heater 4031 is controlled to move the amorphous antenna radiator 402 to a corresponding position of the second target position, or change the shape of the amorphous antenna radiator 402 to a second target shape, or move the amorphous antenna radiator 402 to a corresponding position of the second target position and change the shape of the amorphous antenna radiator 402 to the second target shape, so that the antenna is in the target configuration.

In another embodiment of the present disclosure, referring to FIG. 1 for structure of the antenna, quality of a communication network currently used by the terminal is detected, and it is determined that a signal in CDMA (Code Division Multiple Access) frequency band currently used by the terminal is weak, and that the CDMA frequency band is a currently primarily used frequency band. After a look-up, it is determined that the antenna is in a third target configuration, in a third target position, or changed to a third target shape, or is in a third target position and changed to a third target shape, and has an improved sensitivity to CDMA. Then, the gas pump 1031 is controlled to move the amorphous antenna radiator 102 to a corresponding position in the accommodating cavity, or change the shape of the amorphous antenna radiator 102, or move the amorphous antenna radiator 102 to a corresponding position in the accommodating cavity and change the shape of the amorphous antenna radiator 102, so that the antenna is in the third target configuration.

In another embodiment of the present disclosure, in a debugging stage, signals of the antenna are detected in different frequency bands, and the shape, the position, or the shape and the position of the amorphous antenna radiator are debugged. Antenna configurations that enable standing waves of the antenna to meet requirements so as to achieve optimal communication effects when the terminal is in low-frequency communication, or in intermediate frequency communication, or in high-frequency communication are determined; and optimal configurations of the antenna capable of achieving optimal communication effects when the terminal uses different communication frequency bands are recorded.

Figure 6:
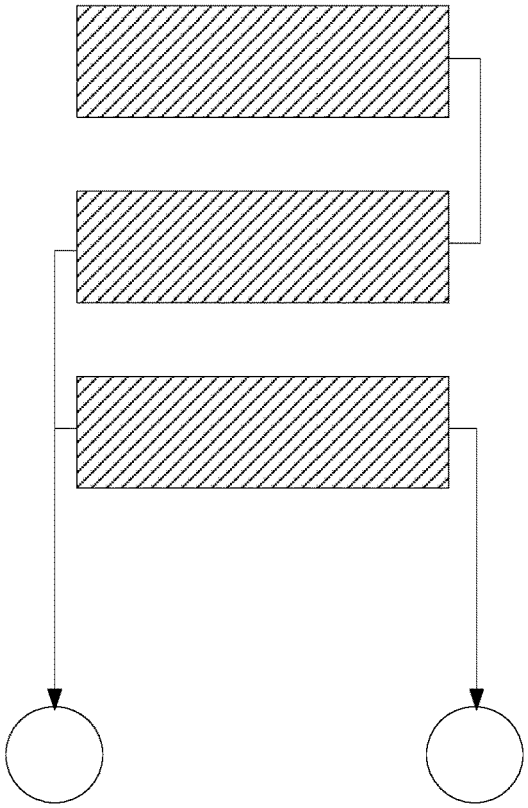
FIG. 6 is a schematic diagram showing a fourth target configuration of an antenna corresponding to a low-frequency signal according to an embodiment of the present disclosure.
Figure 7:
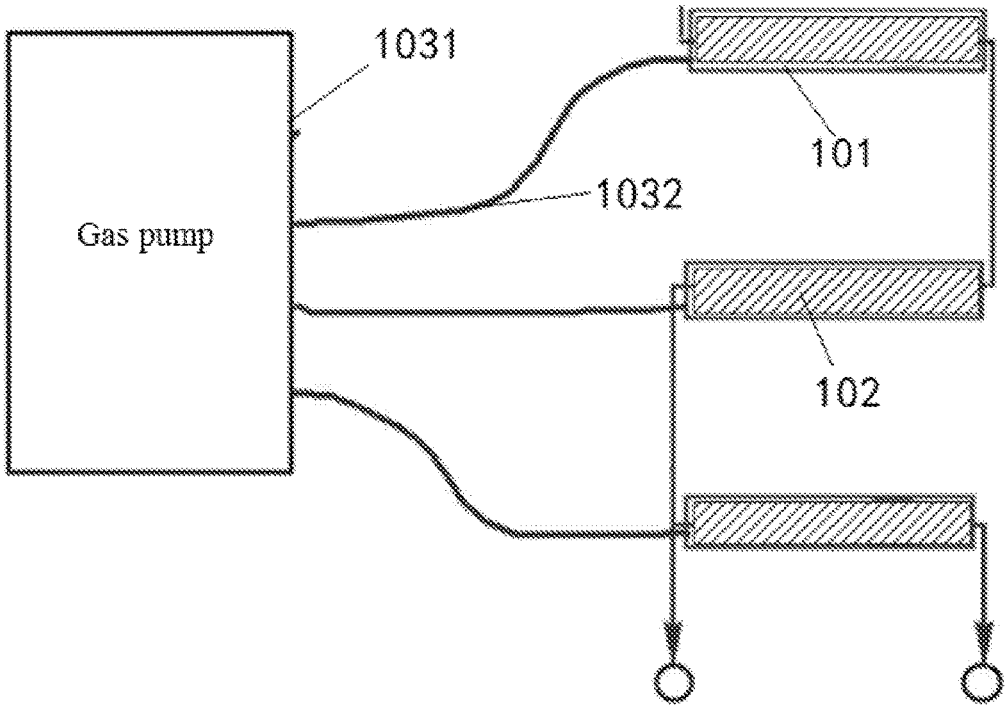
FIG. 7 is a schematic diagram showing a position of an amorphous antenna radiator corresponding to a fourth target configuration according an embodiment of the present disclosure.

For example, referring to FIGS. 6 and 7, the amorphous antenna radiator 102 is controlled by a gas pump 1031 and a gas delivery pipe 1032. When it is detected that the frequency band currently used by the terminal is a low-frequency band, it is determined after a look-up that a target configuration of the antenna corresponding the used frequency band is a fourth target configuration as shown in FIG. 6. Then, the gas pump 1031 is controlled to change the shape, the position, or the shape and the position of the amorphous antenna radiator 102, so that the thickness of the amorphous antenna radiator 102 is decreased and the amorphous antenna radiator 102 is filled with the entire antenna radiator container 101, thereby enabling the antenna to be in the fourth target configuration as shown in FIG. 7, in which the shaded portion represents the amorphous antenna radiator 102.

Figure 8:
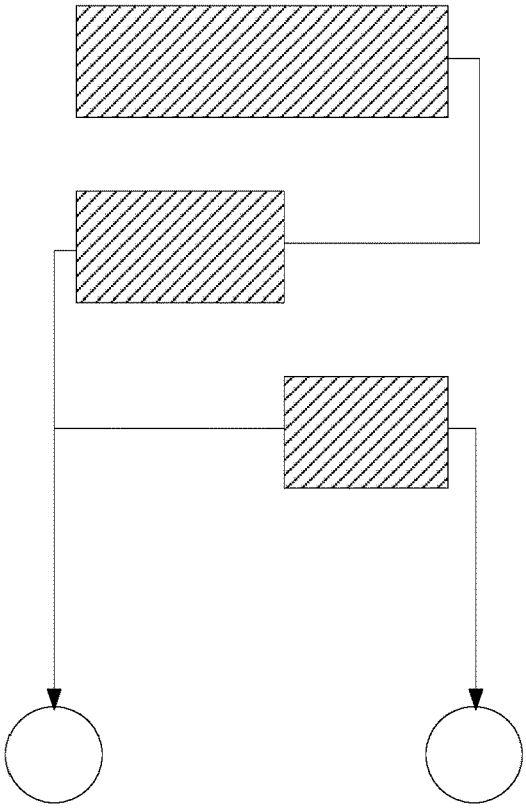
FIG. 8 is a fifth target configuration of an antenna corresponding to an intermediate-frequency signal according to an embodiment of the present disclosure.
Figure 9:
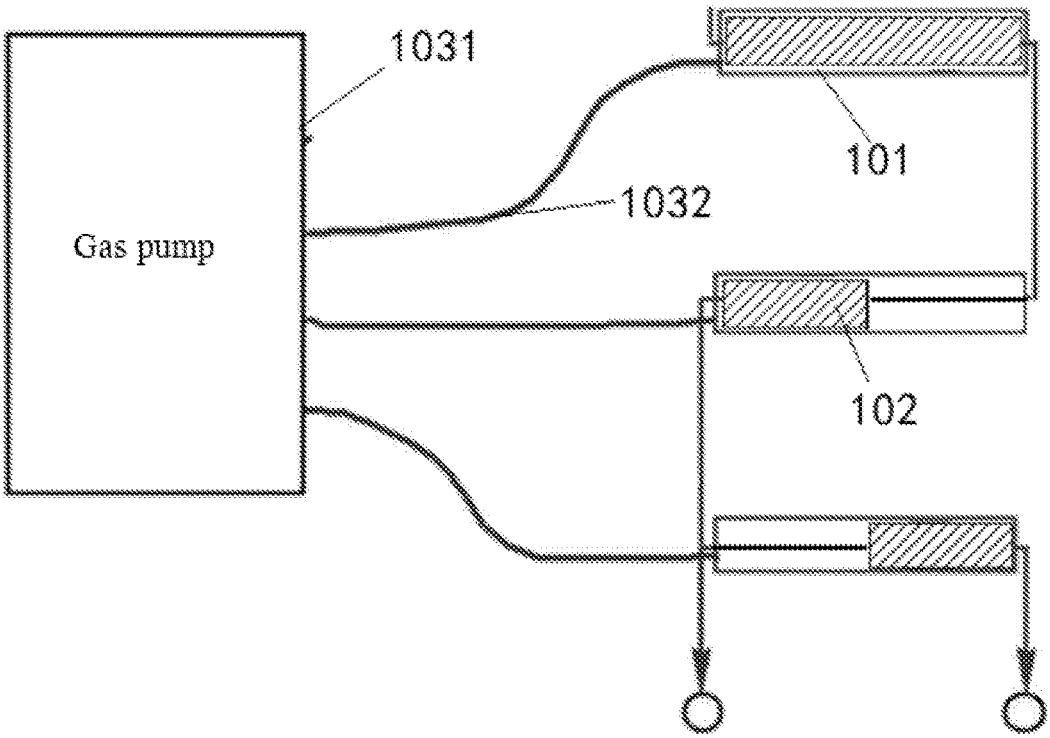
FIG. 9 is a schematic diagram showing a position of an amorphous antenna radiator corresponding to a fifth target configuration according an embodiment of the present disclosure.

As another example, referring to FIGS. 8 and 9, a gas pump is adopted as the antenna radiator control unit 103. When it is detected that the frequency band currently used by the terminal is an intermediate-frequency band, it is determined after a look-up that a target configuration of the antenna corresponding the used frequency band is a fifth target configuration as shown in FIG. 8. Then, the gas pump 1031 is controlled to change the shape, the position, or the shape and the position of the amorphous antenna radiator 102, so that the thickness of the amorphous antenna radiator 102 and the position of the amorphous antenna radiator 102 in the accommodating cavity are changed to thus enable the antenna to be in the fifth target configuration, as shown in FIG. 9.

Figure 10:
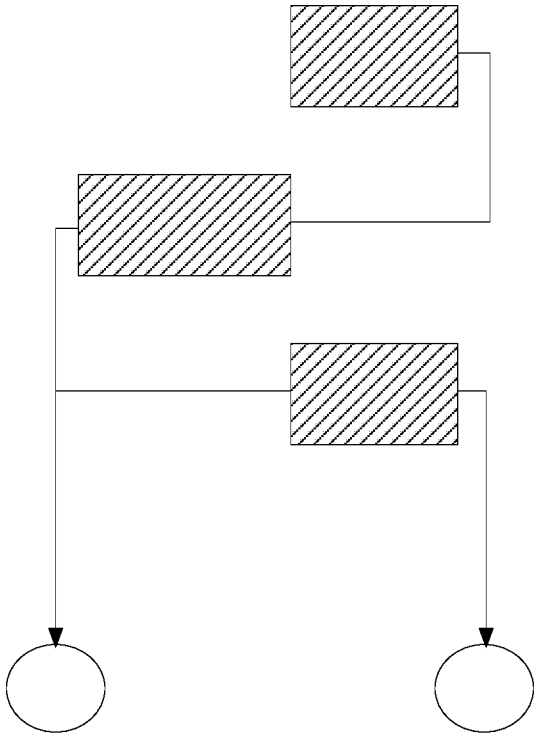
FIG. 10 is a schematic diagram showing a sixth target configuration of an antenna corresponding to a high-frequency signal according to an embodiment of the present disclosure.
Figure 11:
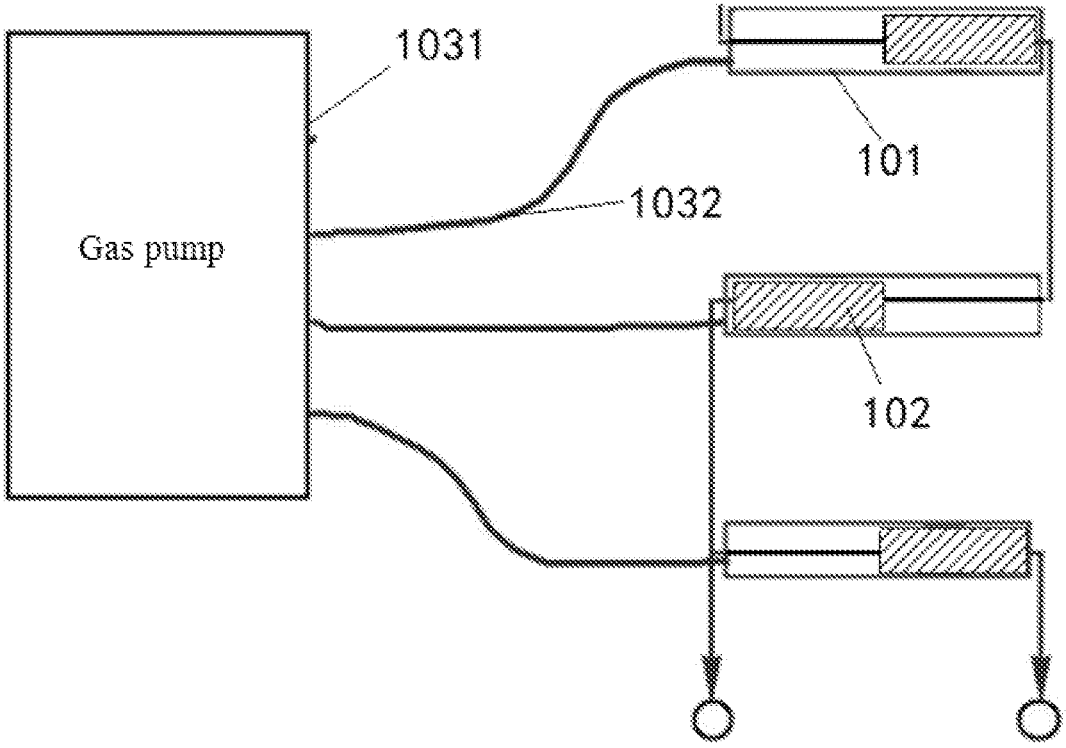
FIG. 11 is a schematic diagram showing a position of an amorphous antenna radiator corresponding to a sixth target configuration according an embodiment of the present disclosure.

As further another example, referring to FIGS. 10 and 11, a gas pump is adopted as the antenna radiator control unit 103. When it is detected that the frequency band currently used by the terminal is a high-frequency band, it is determined after a look-up that a target configuration of the antenna corresponding the used frequency band is a sixth target configuration as shown in FIG. 10. Then, the gas pump 1031 is controlled to change the shape, the position, or the shape and the position of the amorphous antenna radiator 102, so that the thickness of the amorphous antenna radiator 102 and the position of the amorphous antenna radiator 102 in the accommodating cavity are changed to thus enable the antenna to be in the sixth target configuration, as shown in FIG. 10.

The antenna control method provided by the present embodiment, by means of a solution combining hardware and methods, realizes intelligent changes of an antenna, is applicable to different operation states of a terminal, achieves an enhanced adaptability of the antenna to different network environments and physical environments, and is thus capable of greatly improve the communication quality.

An embodiment of the present disclosure provides a computer-readable storage medium having stored thereon computer-executable instructions. The computer-executable instructions, when executed by a processor, implement the above-described antenna control method.

Figure 12:
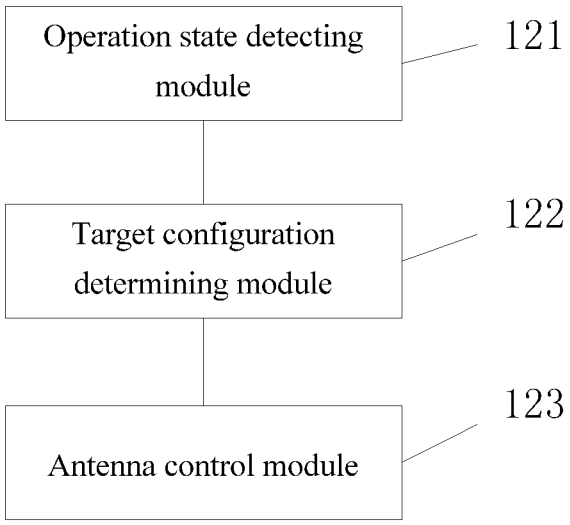
FIG. 12 is a schematic diagram showing an antenna control device according to an embodiment of the present disclosure.

An embodiment of the present disclosure also provides an antenna control device having a structure as shown in FIG. 12. The antenna control device includes:

an operation state detecting module 121, configured to detect a current operation state of a terminal;

a target configuration determining module 122, configured to determine a target configuration of an amorphous antenna radiator, the target configuration including a target position of the amorphous antenna radiator in an accommodating cavity, or including a target shape of the amorphous antenna radiator, or including a target position of the amorphous antenna radiator in an accommodating cavity and a target shape of the amorphous antenna radiator; and an antenna control module 123, configured to control the amorphous antenna radiator through an antenna radiator control unit, so that a position and a shape of the amorphous antenna radiator are consistent respectively with the target position and the target shape.

In some embodiments of the present disclosure, the target configuration determining module includes:

a look-up unit, configured to look up a target configuration of the amorphous antenna radiator under the current operation state of the terminal, based on a corresponding relationship between a preset terminal state and the position and the shape of the amorphous antenna radiator; or a debug control unit, configured to determine the target configuration of the amorphous antenna radiator based on a received debug control instruction.

The antenna control device provided by the embodiments of the present disclosure is applied to the antenna provided by any of the embodiments of the present disclosure.

In some embodiments of the present disclosure, the operation state detecting module includes at least one of the following three units:

a using gesture detecting unit, configured to detect a gesture of a user of the terminal of using the terminal;

a quality detecting unit, configured to detect quality of a communication network currently used by the terminal; and a using frequency band detecting unit, configured to detect a frequency band currently used by the terminal.

The antenna and the antenna control device provided by the embodiments of the present disclosure are cheap and reliable, and are implementable simply by properly arranging the radiator container and the antenna radiator control unit. The antenna and the antenna control device are simple in structure and easy to implement.

An embodiment of the present disclosure also provides a terminal, which may be an electronic device having an antenna, such as a cell phone, a tablet computer, a personal digital assistant (PDA), or an onboard computer or the like. The terminal includes the antenna according to any of the embodiments of the present disclosure, and further includes the antenna control device according to any of the embodiments of the present disclosure.

Figure 13:
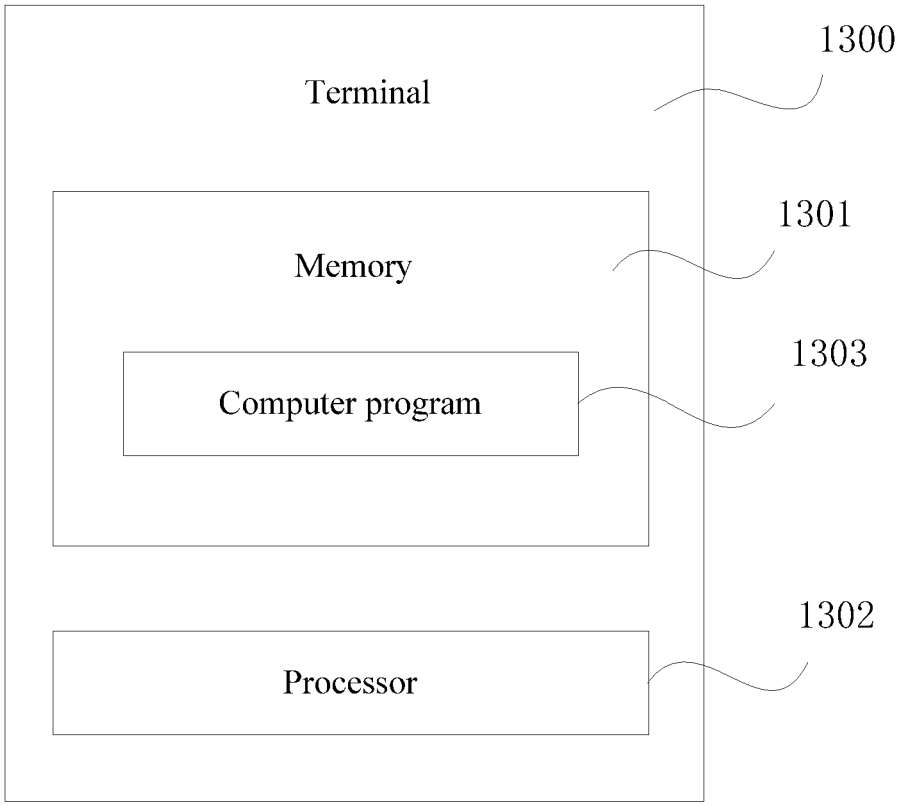
FIG. 13 is a schematic diagram showing a terminal according to an embodiment of the present disclosure.

An embodiment of the present disclosure further provides another terminal. As shown in FIG. 13, the terminal 1300 includes a processor 1302, a memory 1301, and a computer program 1303 stored on the memory 1301 and executable on the processor 1302. The processor 1302, when executing the computer program 1303, implements steps of the antenna control method according to any of the embodiments of the present disclosure.

As can be seen from the above, the antenna, the antenna control method and device, and the terminal provided by the embodiments of the present disclosure can change the position and shape of the antenna radiator according to the operation state of the terminal, so that the antenna radiator can have a configuration that meets a target configuration requirement under the operation state of the terminal, and thus realize optimal antenna communication effects under the current operation state of the terminal. The communication quality of the antenna can thus be improved, and the stability of the communication quality of the antenna in various scenarios and environments can also be improved.

Those of ordinary skill in the art shall appreciate that all or some of the steps of the methods disclosed above, and the functional modules/units of the systems and devices disclosed above, may be implemented as software, firmware, hardware, and any suitable combinations thereof. In hardware implementations, the division between functional modules/units referred to in the above description does not necessarily correspond to the division between physical components. For example, one physical component may have multiple functions, or one function or step may be executed by a combination of a plurality of physical components. Some or all of the components may be implemented as software executed by a processor, such as a digital signal processor or a microprocessor, or be implemented as hardware, or as an integrated circuit, such as an application-specific integrated circuit. Such software may be distributed on a computer-readable medium which may include computer storage medium (or non-transitory medium) and communication medium (or transitory medium). As known by those of ordinary skill in the art, the term computer storage medium includes volatile and nonvolatile, removable and non-removable medium implemented in any method or technology for storage of information (such as computer-readable instructions, data structures, program modules, or other data). Computer storage medium includes, but is not limited to, random access memory (RAM), read only memory (ROM), electrically erasable programmable read-only memory (EEPROM), flash memory or other memory technologies, compact disc read-only memory (CD-ROM), digital versatile disk (DVD) or other optical disk storages, magnetic cassettes, magnetic tapes, magnetic disk storages or other magnetic storages, or any other medium that can be used to store desired information and can be accessed by a computer. In addition, it is known to those of ordinary skill in the art that, communication medium typically contains computer-readable instructions, data structures, program modules or other data in a modulated data signal such as a carrier wave or other transport mechanism, and may include any information delivery medium.

Those of ordinary skill in the art shall appreciate that modifications or equivalent substitutions may be made to the technical solutions of the present application without departing from the spirit and scope of the present application, and all such modifications and substitutions are intended to be included within the scope of the claims of the present application.

INDUSTRIAL APPLICABILITY

The antenna, the antenna control method and device, and the terminal provided by the embodiments of the present disclosure can achieve a good communication effect under different operation states of the terminal.

The invention claimed is:

1. An antenna applied to a terminal, the antenna comprising: an antenna radiator container, an amorphous antenna radiator, and an antenna radiator control unit, wherein the antenna radiator container is provided with a sealed accommodating cavity;

the amorphous antenna radiator is provided in the accommodating cavity of the antenna radiator container; and the antenna radiator control unit is connected with the antenna radiator container and is configured to control a configuration of the amorphous antenna radiator in the accommodating cavity, wherein the configuration comprises a relative position of the amorphous antenna radiator in the accommodating cavity, or comprises a shape of the amorphous antenna radiator, or comprises a relative position of the amorphous antenna radiator in the accommodating cavity and a shape of the amorphous antenna radiator, wherein the accommodating cavity is provided therein with a plurality of separators dividing the accommodating cavity into tubular sub-cavities.

2. The antenna according to claim 1, wherein the amorphous antenna radiator is made of a material that is a liquid metal.

3. The antenna according to claim 2, wherein the antenna radiator control unit comprises a gas pump and a gas delivery pipe, wherein the gas delivery pipe is connected at one end thereof with the gas pump, and is connected at the other end thereof with the accommodating cavity; and the gas pump is configured to control the shape of the amorphous antenna radiator and the relative position of the amorphous antenna radiator in the accommodating cavity by drawing a gas in the accommodating cavity.

4. The antenna according to claim 2, wherein the antenna radiator control unit includes a heater and a heating pipe, wherein the heating pipe is connected at one end thereof with the heater, and is connected at the other end thereof the accommodating cavity; and the heater is configured to control the shape of the amorphous antenna radiator and the relative position of the amorphous antenna radiator in the accommodating cavity by controlling a temperature of a gas in the accommodating cavity.

5. The antenna according to claim 4, wherein the heating pipe is electrically connected with the amorphous antenna radiator, and is configured to change the shape of the amorphous antenna radiator by controlling a temperature of the amorphous antenna radiator.

6. The antenna according to claim 1, wherein the tubular sub-cavities being parallel to one another in extension directions thereof and being in communication with one another.

7. The antenna according to claim 1, wherein the antenna radiator container is made of a plastic material, a different between a dielectric constant of the plastic material and a dielectric constant of the amorphous antenna radiator being greater than a preset value.

8. The antenna according to claim 1, wherein when provided is a plurality of antenna radiator containers, the antenna further comprises an equal-impedance electric conductor that electrically connects amorphous antenna radiators in the antenna radiator containers together.

9. The antenna according to claim 8, wherein the equal-impedance electric conductor is a wire, or, the equal-impedance electric conductor comprises a conductor container and an amorphous conductor filled in the conductor container, the amorphous conductor electrically connecting the amorphous antenna radiators in the antenna radiator containers together.

10. A terminal comprising the antenna according to claim 1.

* * * * *